United States Patent [19]

Higginbotham

[11] 4,275,528

[45] Jun. 30, 1981

[54] ELECTROPLATED DIAMOND MILLING CUTTER

[75] Inventor: Eugene E. Higginbotham, Salt Lake City, Utah

[73] Assignee: Christensen, Inc., Salt Lake City, Utah

[21] Appl. No.: 73,920

[22] Filed: Sep. 10, 1979

[51] Int. Cl.[3] ..... B24B 7/00

[52] U.S. Cl. ..... 51/206 P; 125/5; 299/89

[58] Field of Search ..... 51/206 R, 206 P; 125/3, 125/5, 15, 39; 299/89

[56] References Cited

U.S. PATENT DOCUMENTS

| | | | |
|---|---|---|---|
| 3,196,585 | 7/1965 | Christensen | 51/206 P |
| 3,398,989 | 8/1968 | Christensen | 125/39 |
| 3,462,887 | 8/1969 | Hackman | 51/206 P |
| 3,554,606 | 1/1971 | Mabey | 125/39 |
| 3,602,209 | 8/1971 | Bocker | 51/206 P |
| 3,691,707 | 9/1972 | Von Arx | 125/15 |

FOREIGN PATENT DOCUMENTS

| | | | |
|---|---|---|---|
| 703060 | 2/1941 | Fed. Rep. of Germany | 51/206 P |
| 120800 | 11/1918 | United Kingdom | 51/206 P |

*Primary Examiner*—Harold D. Whitehead
*Attorney, Agent, or Firm*—Subkow and Kriegel

[57] ABSTRACT

A milling cutter rotatable about an axis and including a cylindrical steel core having helical tapered threads, such as V-shaped threads, diamond grit of a suitable mesh being appropriately secured, as by nickel plating, onto the crests, roots and flanks of the threads, the diamonds being substantially contiguous one another and so related to each other that as the cutter rotates against the work, the individual crest diamonds will first cut the work and eventually break off. Because of the helical pattern, the cutting action will continue, since one of the other diamonds lying in the same transverse plane normal to the axis as the missing diamond will operate upon the work being cut. The loss of the outermost or crest diamonds will expose diamonds in the tapered flanks of the thread to provide cutting points on the cylinder that are operable to cut the work, the flank diamonds traversing the same path normal to the axis of the cutter as the crest diamonds. The flank diamonds and the steel material with which the work is engageable also wear down or break off and expose succeeding diamonds and cutting points that operate on the work in the same transverse plane as the diamonds that have been lost.

22 Claims, 6 Drawing Figures

FIG. 4.
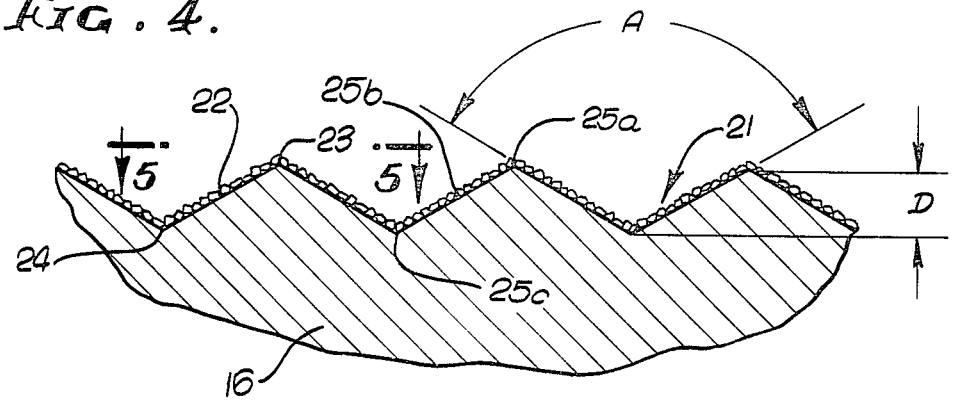
FIG. 5.
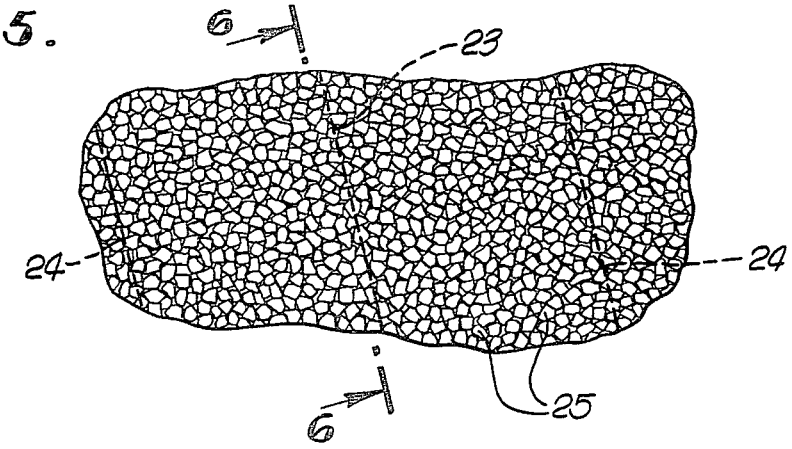
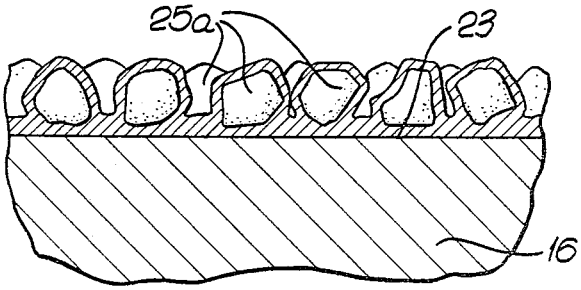
FIG. 6.

ELECTROPLATED DIAMOND MILLING CUTTER

The present invention relates to milling cutters, and more particularly to milling cutters for cutting, sizing or resurfacing non-metallic material, such as refractories for furnace linings, brick, concrete, asphalt paving, marble, granite, slate, ceramics, plastics, and the like.

A diamond milling cutter of cylindrical form has been proposed, with diamond grit secured to the periphery of the cylindrical member by electroplating, nickel preferably being the electroplating medium. Such cutters have been used for surfacing blocks of materials of the nature specified above, but they have lasted only about a week in service because of the loss of diamonds from the cylindrical body or member.

An object of the present invention is to greatly extend the life of a milling cutter and particularly a milling cutter having diamond cutter elements that are secured by electroplating onto the main body or member of the milling tool. It has been found that the life of the milling cutter was increased about six times by providing a cylindrical body or member with a helical thread cut into its periphery, with diamonds secured by electroplating onto the crests, roots and tapered flanks of the helical threads, such as a multiple start thread. As the cutter rotates, the outermost diamonds eventually break off, their cutting action being taken over by the next succeeding diamonds on the flanks of the threads, which lie in the same plane normal to the axis of rotation of the milling tool as the diamonds that have been lost.

This invention possesses many other advantages, and has other objects which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIG. 4 is a fragmentary longitudinal section, on a greatly enlarged scale, disclosing the threaded configuration of the periphery of the cutter body or member;

FIG. 5 is an enlarged plan view taken on the line 5—5 on FIG. 4; and FIG. 6 is a still further enlarged section taken on the line 6—6 on FIG. 5.

Figure 1:
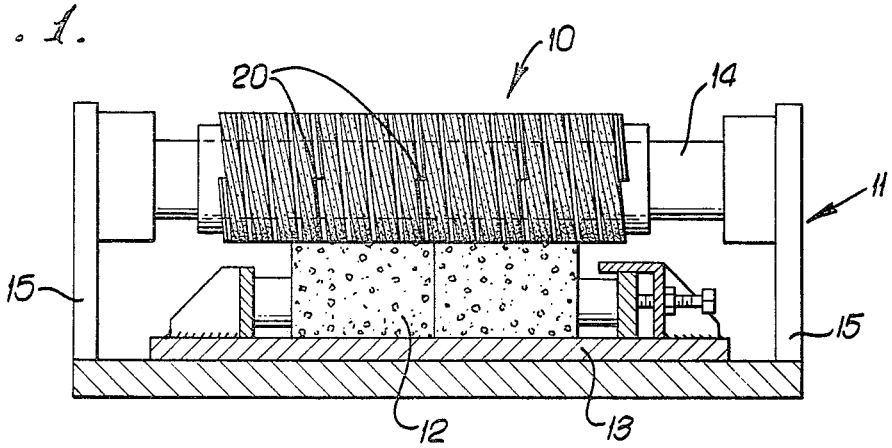
FIG. 1 is an end view, partly in section, of a machine in which a milling cutter embodying the invention is mounted.
Figure 2:
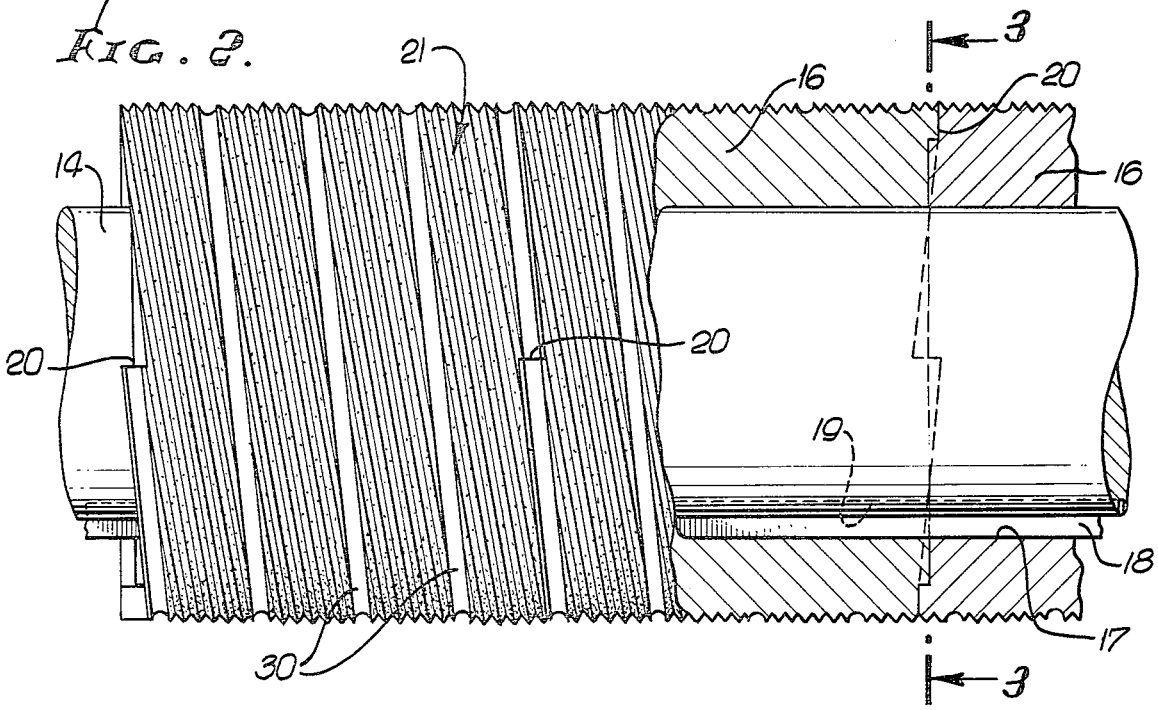
FIG. 2 is a combined side elevational view and longitudinal section through a milling cutter assembly mounted in the machine disclosed in FIG. 1.
Figure 3:
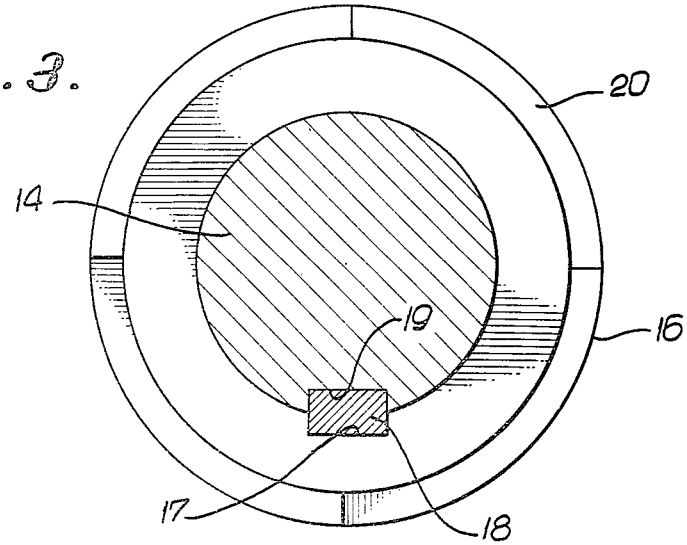
FIG. 3 is a cross-section taken along the line 3—3 on FIG. 2.

As shown in FIG. 1, a cutter assembly 10 is disclosed as being mounted in a machine 11 which rotates the assembly at an appropriate speed, enabling it to take a cut upon work 12 mounted in the machine. This work, for example, may be a plurality of refractory or concrete blocks mounted upon and suitably secured to the bed 13 of the machine, which is adapted to move the work transversely of the rotatable cutter assembly. The machine itself includes a drive shaft or spindle 14 suitably rotatably mounted in the supporting frame 15 and to which the cutter members or sections 16 are secured.

The cutter members are identical to one another, each including an annular body that can be made of steel and through which the drive shaft passes, the body being secured to the body by an internal longitudinal keyway 17 receiving a key 18 which also extends within a longitudinal external keyway 19 in the drive shaft or spindle.

The plurality of cylindrical cutter sections is secured together because of the interengagement of end teeth 20 on each cutter. This particular arrangement constitutes no part of the present invention and is illustrated in U.S. Pat. No. 3,196,585. The cutters are retained axially against one another by suitable means (not shown).

A helical thread 21 (FIGS. 4,5) is provided on the cylindrical periphery of each cylindrical body 16, this thread preferably being a multiple start thread, and the thread itself preferably being V-shaped. Diamonds 25*a*, 25*b*, 25*c* of a suitable mesh are electroplated onto the thread flanks or faces 22, crests 23 and root portions 24, the diamonds being closely adjacent to or contiguous one another and substantially fully covering the entire surfaces of the flanks, roots and crests. As pointed out above, as the cutter rotates, the individual diamonds 25*a* at the crests will first break off, but because of the helical pattern, the cutting action will continue since one of the other diamonds 25*b* in the flanks, which lies in the same transverse plane as the missing diamond, will operate upon the material being cut. The wearing down of the outermost or crest diamonds will expose diamonds in the tapered flanks of the thread to provide cutting points on the cylindrical body 16 that are operable to cut the work, the flank diamonds traversing the same path normal to the axis of the cutter as the crest diamonds. The flank diamonds and the steel material in which they are mounted will also wear down and progressively expose succeeding diamonds and cutting points that operate on the work in the same plane as the diamonds that have been lost due to wear. In other words, the diamonds overlap one another because of the pitch of the threads.

The mesh of the diamonds is relatively small, ranging from 12 to 35 mesh U.S. Standard Screen Size. It is preferred to use 18 to 20 mesh diamonds. The included angle A between adjacent and opposed flanks of the thread can range from about 105° to 135°, and the depth D of the thread groove can range from about 0.015 to 0.100 inches. A preferred included angle is 120° and the preferred depth of the groove is 0.020 inches.

In attaching the diamonds to the threads of the cylindrical body, the latter is cleaned in a cleaning solution and hung in a nickel bath for a base strike. It is then pulled from the nickel bath, rinsed off and masking plates (not shown) placed against each end of the body. This assembly is then inserted into a basket in a nickel plating solution, and a series of gates placed in surrounding relation to the assembly, leaving a small clearance which may, for example, be about a quarter of an inch away from the body. This clearance or annular cavity is then totally filled with diamond grit of a preferred mesh, which is compressed, compacted and vibrated so that each interior diamond is resting solidly against the threaded crest, flank and root portions of the steel body. The electroplating action is started and the nickel starts building up onto the steel body and onto or around the first layer of diamonds touching the steel body (FIG. 6). When the nickel has attached the diamonds sufficiently to the steel surfaces, the gates are pulled away, allowing the many excess layers of diamonds that are in the clearance space to drop away from the assembly. With only one layer of diamonds left adhering to the crests, flanks and roots of the threads, the plating continues until the nickel has surrounded each diamond with at least an 80% to 90% surface coverage, as seen in FIG. 6, wherein the thickness of the plating is exaggerated for purpose of illustration.

In electroplating the diamonds to the steel cylindrical body, no new electroplating techniques, per se, are used, the nickel plating covering the crests, flanks and roots of the threads, and also substantially surrounding each diamond, thereby attaching the latter to the steel body member.

To facilitate the cleaning and cooling of the diamond milling cutter and the removal of cuttings from the material 12 being operated upon, helical fluid courses 30 are formed in the periphery of each cutter. The helical angle of these fluid courses has no bearing on the helical angle of the threads. As shown, the fluid courses actually cut across the threads.

The arrangement illustrated and described provides a single layer of diamond cutting elements that can perform as if the diamond cutting elements were plated to the body in multiple layers. This is due to the overlapping relation between the diamonds and the crests, flanks and root portions of the cutter body that lie in the same plane normal to the axis of rotation of the milling tool. As a result, the milling cutter has a useful life that is several times that of prior unthreaded cylindrical cutter members having a single diamond layer adhered by plating their cylindrical peripheries.

I claim:

1. A milling cutter comprising a generally cylindrical body adapted to be rotated about an axis and having a helical thread extending around its periphery through a plurality of revolutions, said thread including a crest portion, a root portion and tapered flank portions extending between said crest and root portions, and a single layer of a multiplicity of diamond particles bonded to and extending from the external surfaces of said crest, flank and root portions, said diamond particles of said single layer being contiguous each other and overlapping each other progressively along said crest portion, flank portion and root portion in a direction normal to said axis, the width of said crest portion being no greater than the width of each diamond particle bonded to said crest portion.

2. A milling cutter as defined in claim 1; said thread being V-shaped.

3. A milling cutter as defined in claim 1; said diamond particles collectively covering substantially the entire surfaces of said crest, flank and root portions.

4. A milling cutter as defined in claim 1; said particles being bonded to said crest, root and flank portions by electroplating them with a metal.

5. A milling cutter as defined in claim 4; said metal being nickel.

6. A milling cutter as defined in claim 1; the included angle between adjacent tapered flank portions being from about 105° to about 135°.

7. A milling cutter as defined in claim 1; the included angle between adjacent tapered flank portions being about 125°.

8. A milling cutter as defined in claims 1 or 6; the depth of the thread groove between the crest portion and root portion being from about 0.015 to about 0.100 inches.

9. A milling cutter as defined in claims 1 or 7; the depth of the thread groove between the crest portion and root portion being about 0.020 inches.

10. A milling cutter as defined in claims 1 or 6; the mesh size of said diamond particles being from about 12 to about 35 U.S. Standard Screen.

11. A milling cutter as defined in claims 1 or 7; the mesh size of said diamond particles being from about 18 to about 20 U.S. Standard Screen.

12. A milling cutter comprising a generally cylindrical body adapted to be rotated about an axis and having a helical thread extending around its periphery through a plurality of revolutions, said thread including a crest portion, a root portion and tapered flank portions extending between said crest and root portions, and a single layer of a multiplicity of diamond particles bonded to and extending from the external surfaces of said crest, flank and root portions, said diamond particles of said single layer being contiguous each other and overlapping each other progressively along said crest portion, flank portion and root portion in a direction normal to said axis.

13. A milling cutter as defined in claim 12; said thread being V-shaped.

14. A milling cutter as defined in claim 12; said diamond particles collectively covering substantially the entire surfaces of said crest, flank and root portions.

15. A milling cutter as defined in claim 12; said particles being bonded to said crest, root and flank portions by electroplating them with a metal.

16. A milling cutter as defined in claim 15; said metal being nickel.

17. A milling cutter as defined in claim 12; the included angle between the adjacent tapered flank portions being from about 105° to about 135°.

18. A milling cutter as defined in claim 12; the included angle between adjacent tapered flank portions being about 125°.

19. A milling cutter as defined in claims 12 or 17; the depth of the thread groove between the crest portion and rib portion being from about 0.015 to about 0.100 inches.

20. A milling cutter as defined in claims 12 or 18; the depth of the thread groove between the crest portion and rib portion being about 0.020 inches.

21. A milling cutter as defined in claims 13 or 17; the mesh size of said diamond particles being from about 12 to about 35 U.S. Standard Screen.

22. A milling cutter as defined in claims 12 or 18; the mesh size of said diamond particles being from about 18 to about 20 U.S. Standard Screen.

* * * * *